US007217683B1

(12) United States Patent
Blanski et al.

(10) Patent No.: US 7,217,683 B1
(45) Date of Patent: May 15, 2007

(54) LUBRICATION VIA NANOSCOPIC POLYHEDRAL OLIGOMERIC SILSESQUIOXANES

(76) Inventors: Rusty L. Blanski, 44448 Overland Ave., Lancaster, CA (US) 93536; Shawn H. Phillips, 2763 Legends Way, Lancaster, CA (US) 93536; Stephen L. Rodgers, 108 Fox Hollow Ct., Madison, AL (US) 35758; Joseph D. Lichtenhan, 31085 Via Sonora, San Juan Capistrano, CA (US) 92675; Joseph J. Schwab, 16352 Bradbury, Huntington Beach, CA (US) 92647

( * ) Notice: Subject to any disclaimer, the term of this patent is extended or adjusted under 35 U.S.C. 154(b) by 357 days.

(21) Appl. No.: 10/236,461

(22) Filed: Sep. 5, 2002

Related U.S. Application Data

(60) Provisional application No. 60/317,500, filed on Sep. 5, 2001.

(51) Int. Cl.
*C10M 139/00* (2006.01)
*C10M 171/06* (2006.01)

(52) U.S. Cl. ..... 508/208; 508/107; 508/203

(58) Field of Classification Search ..... 508/208
See application file for complete search history.

(56) References Cited

U.S. PATENT DOCUMENTS

| | | | | |
|---|---|---|---|---|
| 2,801,968 A | | 8/1957 | Furby et al. | 252/32.5 |
| 3,231,499 A | | 1/1966 | Smith | 252/57 |
| 3,247,111 A | | 4/1966 | Oberright et al. | 252/34.7 |
| 3,267,031 A | | 8/1966 | Fritz | 252/18 |
| 3,278,436 A | | 10/1966 | Dazzi et al. | 252/50 |
| 3,280,031 A | | 10/1966 | Brennan et al. | 252/49.8 |
| 3,293,180 A | | 12/1966 | Axworthy | 252/28 |
| 3,340,286 A | | 9/1967 | Schiefer et al. | 260/448.2 |
| 3,347,791 A | | 10/1967 | Thomson et al. | 252/33.6 |
| 3,673,226 A | | 6/1972 | Malec | 260/410.6 |
| 3,909,424 A | * | 9/1975 | Clark | 508/121 |
| 3,912,640 A | | 10/1975 | Auzenberger, Sr. | 252/47.5 |
| 4,049,563 A | | 9/1977 | Burrous | 242/49.9 |
| 4,377,608 A | * | 3/1983 | Daudt et al. | 427/350 |
| 4,501,616 A | | 2/1985 | Fink et al. | 106/38.22 |

(Continued)

FOREIGN PATENT DOCUMENTS

EP 0294096 A1 12/1988

(Continued)

OTHER PUBLICATIONS

Mantz, R.A., Jones, P.F., Chaflee, K.P., Lichtenhan, J.D., Gilman, J.W., Ismail, I.M.K., Burmeister, M.J. *Chem. Mater.*, 1996, 8, 1250-1259.

*Primary Examiner*—Ellen M. McAvoy
(74) *Attorney, Agent, or Firm*—David H. Jaffer; Pillsbury Winthrop Shaw Pittman LLP

(57) ABSTRACT

Nanoscale chemicals based on polyhedral oligomeric silsesquioxanes (POSS) and polyhedral oligomeric silicates (POS) are taught as lubricants, mold release agents, and as additives to control the viscosity, lubrication, wear, and thermal properties of conventional lubricous materials. The precisely defined nanoscopic dimensions of POSS materials enable viscosity, miscibility, and thermal properties to be (increased) or reduced (decreased) as desired. A key feature to the successful tailoring of properties is the inherent thermal and chemical stability of the POSS/POS nanostructure and the ability to control its topology and chemical potential to match that of surfaces and other materials.

6 Claims, 9 Drawing Sheets

Example of Polysilsesquioxane Resins $[RSiO_{1.5}]_n$

Examples of Homoleptic POSS Systems $[(RSiO_{1.5})]_{T8}$

Example of a Heteroleptic POSS System $[(RSiO_{1.5})_n(R'SiO_{1.5})_m]_{T8}$

Example of a Functionalized Homoleptic POSS System $[(RSiO_{1.5})_n(RXSiO_{1.0})_m]_{T8}$ Example of a Functionalized Heteroleptic POSS System $[(RSiO_{1.5})_n(R'SiO_{1.5})_m(RXSiO_{1.0})_p]_{T8}$ Example of a Polyhedral Oligomeric Silicate System $[(XSiO_{1.5})_n]_{T8}$ Fragment Examples: $RSiX_3$ (1), $[(RXSiO_{0.5})_n]$ (2), $[(RXSiO_{1.0})_n]$ (3), $[(RSiO_{1.5})_n(RXSiO_{1.0})_m]$(4)

Examples of Common Silsesquioxane, Silicate, POSS Nanostructures and Fragments.

U.S. PATENT DOCUMENTS

| | | | | |
|---|---|---|---|---|
| 4,519,927 | A | 5/1985 | Seiki | 252/49.6 |
| 5,047,492 | A | 9/1991 | Weidner et al. | 528/15 |
| 5,079,299 | A | 1/1992 | Hisamoto et al. | 525/100 |
| 5,484,867 | A | 1/1996 | Lichtenhan et al. | 529/9 |
| 5,858,544 | A | 1/1999 | Banaszak Holl et al. | 428/447 |
| 5,939,576 | A | 8/1999 | Lichtenhan et al. | 556/460 |
| 5,942,638 | A | 8/1999 | Lichtenhan et al. | 556/460 |
| 6,100,417 | A | 8/2000 | Lichtenhan et al. | 556/460 |

FOREIGN PATENT DOCUMENTS

| | | |
|---|---|---|
| EP | 0294096 B1 | 2/1991 |
| WO | WO 8701722 | 3/1987 |

* cited by examiner

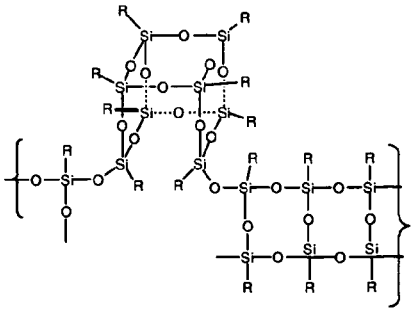
Example of Polysilsesquioxane Resins $[RSiO_{1.5}]_{\infty}$
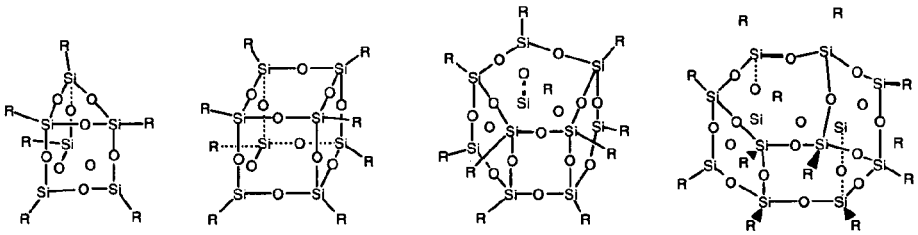
$[(RSiO_{1.5})_6]_{\Sigma 6}$ $[(RSiO_{1.5})_8]_{\Sigma 8}$ $[(RSiO_{1.5})_{10}]_{\Sigma 10}$ $[(RSiO_{1.5})_{12}]_{\Sigma 12}$
Examples of Homoleptic POSS Systems $[(RSiO_{1.5})]_{\Sigma\#}$
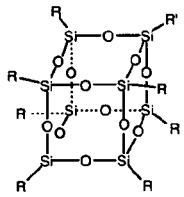
$[(RSiO_{1.5})_7(R'SiO_{1.5})_1]_{\Sigma 8}$
Example of a Heteroleptic POSS System $[(RSiO_{1.5})_n(R'SiO_{1.5})_m]_{\Sigma\#}$
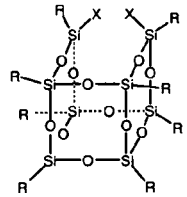
$[(RSiO_{1.5})_6(RXSiO_{1.0})_2]_{\Sigma 8}$
Example of a Functionalized Homoleptic POSS System $[(RSiO_{1.5})_n(RXSiO_{1.0})_m]_{\Sigma\#}$
FIG. 1/1

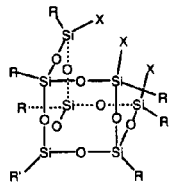
$[(RSiO_{1.5})_3(R'SiO_{1.5})_1(RXSiO_{1.0})_3]_{\Sigma 7}$
Example of a Functionalized Heteroleptic POSS System $[(RSiO_{1.5})_n(R'SiO_{1.5})_m(RXSiO_{1.0})_p]_{\Sigma\#}$
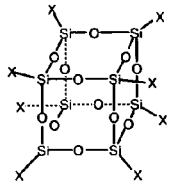
$[(XSiO_{1.5})_8]_{\Sigma 8}$
Example of a Polyhedral Oligomeric Silicate System $[(XSiO_{1.5})_n]_{\Sigma\#}$
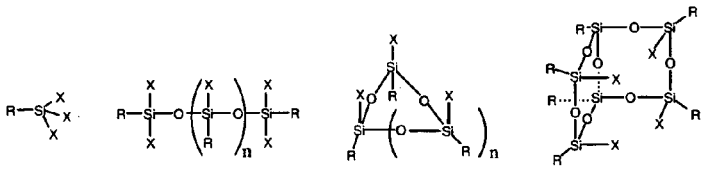
1 2 3 4
Fragment Examples: $RSiX_3$ (1), $[(RXSiO_{0.5})_n]$ (2), $[(RXSiO_{1.0})_n]$ (3), $[(RSiO_{1.5})_n(RXSiO_{1.0})_m]$(4)
Examples of Common Silsesquioxane, Silicate, POSS Nanostructures and Fragments.
FIG. 1/2

Examples of POSS/POS Nanostructures, Fragments, and Resins for use as lubricants, releases and as additives.

Physical size relationships of a traditional silane applied to a surface as a monolayer (left) and nanoscale coupling agents applied as monolayers.

Illustration of inter and intramolecular free volume for a lubricant.

Examples of monodisperse Molecular Silicas™ .

Viscosity behavior for $[(c\text{-hexylSiO}_{0.5})_2(n\text{-octyl}(CH_3)_2\text{SiO}_{1.0})_4]$ $[(c\text{-hexylSiO}_{0.5})_2(n\text{-decyl}(CH_3)_2\text{SiO}_{1.0})_4]$ $[(c\text{-hexylSiO}_{0.5})_2(n\text{-dodecyl}(CH_3)_2\text{SiO}_{1.0})_4]$.

Viscosity behavior for a 90/10 wt% blend of $[(c\text{-hexylSiO}_{0.5})_2(n\text{-}octyl(CH_3)_2SiO_{1.0})_4]/[(c\text{-hexylSiO}_{0.5})_2(n\text{-}dodecyl(CH_3)_2SiO_{1.0})_4]$.

Viscosity behavior $[(\text{isoocytylSiO}_{1.5})]_{\Sigma 10}$

LUBRICATION VIA NANOSCOPIC POLYHEDRAL OLIGOMERIC SILSESQUIOXANES

The present application claims priority from provisional application Ser. No. 60/317,500 filed on Sep. 5, 2001.

BACKGROUND OF THE INVENTION

1. Field of the Invention

The present invention relates to use of polyhedral oligomeric silsesquioxanes (POSS) and polyhedral oligomeric silicates (POS) as lubricants, mold release agents, and additives to control the viscosity, lubrication, wear, and thermal properties of conventional lubrious materials.

2. Description of the Prior Art

Prior Art Lubricants

There is a continuing need for lubricants and fluids which are capable of functioning at temperature extremes such as from sub-zero temperatures to 540° C. or higher. For example, synthetic lubricants for jet engines and experimental low heat rejection engines such as adiabatic engines, hydraulic fluids for supersonic aircraft and coolants for electronic equipment are required to function over this wide range of temperatures. These temperature range requirements present difficult problems of developing compositions which are liquid and thermally stable at the very high temperatures, and which remain in liquid form at low temperatures. It is also necessary to design materials which have adequate temperature-viscosity properties and lubricity and which have adequate lubricating characteristics within the entire temperature range.

Similarly, piston engines used in automobiles or generally as power sources often have water or air-cooled cylinders in order to keep the cylinder walls cool enough to permit oil lubrication of the piston. Lubricating oil compositions primarily based upon mineral oils and including various chemical additives have been effective lubricants of the present-age combustion engines. Automotive engineers, however, are developing a new generation of engines that are expected to be more powerful, use less fuel, weigh less and be smaller than existing engines. These future engines are being designed to operate at exceedingly high temperatures since it has been established that when engines run at higher temperatures, fuel efficiency increases. The high temperatures in the new engines will be attained by removing the cooling system from the engine which will also allow the engines to be smaller.

Most present-day lubricants based upon mineral hydrocarbon oils cannot withstand such high temperatures or perform satisfactorily at such high temperatures because the mineral oil decomposes or is volatile thereby leaving the movable engine parts poorly lubricated. Additionally, the decomposition of the mineral oil results in the formation of deposits. An ideal lubricating fluid for the expected high temperature or "adiabatic" engines should possess most if not all of the following characteristics: good deposit prevention, low volatility, high thermal stability, good oxidative stability, satisfactory corrosion control, good wear control, satisfactory friction control, and acceptable viscometrics.

Various lubricants have been suggested in the prior art for use at temperatures of up to about 200° C. or 230° C. including the lubricants which have been used to lubricate moving parts of jet and turbo-jet engines. Most of the lubricants which have been suggested for use and which have been effective in lubricating jet engines have utilized high boiling synthetic oils as the base stock. Synthetic esters derived from polyhydroxyl compounds and various compounds containing reactive carboxylic acid groups have been suggested as useful base oils for lubricants to be used at high temperatures such as obtained in jet engines. For example, U.S. Pat. Nos. 3,231,499; 3,340,286; 3,347,791; 4,049,563; and 4,519,927 describe the use of various synthetic esters, either alone or in combination with other materials such as synthetic ethers and silicones in high temperature lubricants. Generally, the lubricant is formulated to contain various chemical additives to improve specific properties including thermal stability, oxidation stability, reduced deposit formation, etc. For example, detergents and dispersants for use in synthetic ester lubricants are described in U.S. Pat. Nos. 3,231,499; 3,347,791; and 4,519,927. Alkali metal salts of carboxylic acids and hydroxyl-containing aromatic compounds are described in U.S. Pat. No. 3,347,791 as useful detergents, and calcium stearate is an example found therein.

Similarly U.S. Pat. No. 4,519,927 describes lubricant formulations useful at high temperatures and which comprise a mixture of an aryl alkyl silicone and a fatty acid ester of a hindered alcohol such as trimethylol propane or pentaerythritol. The patentees indicate that the lubricants may contain other additives such as amine-, phenol-, and dithiophosphoric acid-type antioxidants, sulfonate-, phenate-, phosphonate-, and salicylate-type detergents, dispersants, sulfur/phosphorus-, and phosphate-type extreme pressure agents, and oiliness agents. Such additives are illustrated in the examples by phenothiazine, calcium sulfonate, calcium phenate, barium phosphonate, and tricresylphosphate. Examples of amine antioxidants described in this patent include phenyl-alpha-naphthylamine and phenothiazine.

The use of high boiling synthetic ethers as base oils for lubricants for jet engines is described in U.S. Pat. No. 2,801,968, and polyolefins such as polyalphaolefins are described as useful base stocks in high temperature lubricants in U.S. Pat. No. 3,280,031. The use of silicon fluids, either alone or in combination, as base oils for high temperature lubricants is described in, for example, U.S. Pat. Nos. 3,267,031; 3,293,180; and 4,049,563.

Published European Patent Application 0294096 describes lubricants based on natural or synthetic base stocks which contain a high molecular weight carboxylic dispersant and a metal detergent which may be a neutral or basic sulfurized alkyl phenol. The lubricants may contain other additives such as antioxidants. Examples of antioxidants include calcium nonyl phenol sulfide, dioctyldiphenyl amine and phenyl alpha-naphthyl amine.

The patent WO 87/01722 describes diesel lubricants containing a natural or synthetic base stock containing a carboxylic derivative dispersant and a basic alkali metal salt. The lubricants may contain other additives such as metal dithiophosphates, various detergents including metal carboxylates, sulfonates and phenates, and antioxidants. One example of a metal detergent is a basic calcium salt of a sulfurized tetrapropenyl phenol, and an alkylated aromatic amine is also included in the oil.

High temperature lubricants specifically designed for jet aircraft are described in U.S. Pat. No. 3,247,111 which are comprised of a major proportion of a synthetic ester, minor amounts of various additives including antioxidants which include amines, phenols, esters, phosphites, etc. Examples of antioxidants described in this patent include diaromatic amines such as dinaphthyl amine, and hindered phenols such as 2,4-di-tertiarybutyl p-cresol, etc. Combinations of different diaromatic amines are described as being preferred.

U.S. Pat. No. 3,278,436 describes lubricants containing certain melamine derivatives as an essential lubricating ingredient in combination with other lubricants which include synthetic esters. Antioxidants are also included in the lubricating compositions to hinder the auto oxidation which occurs at temperatures above 150° C. Cyclic aromatic amines and hydroxy-substituted aromatics are described as useful antioxidants. Of the antioxidants in the class of hydroxyl-substituted aromatics, hindered phenols such as 2,6-di-tert-butyl-4-ethyl phenol and methylene coupled hindered phenols such as 2,2'-methylene-bis-(4-methyl-6-tert butyl phenyl) are identified. Synthetic ester lubricants also containing antioxidants which may be aromatic amines or of the phenolic type are also described in U.S. Pat. No. 3,673,226. Synthetic ester-based gas turbine lubricants containing diaromatic amines and methylene coupled phenols such as 4,4'-methylene-bis(2,6-di-t-butyl phenyl) are described in U.S. Pat. No. 3,912,640. The base stock utilized in the preparation of these lubricants comprise a blend of a synthetic ester and a low viscosity mineral oil. The amount of mineral oil may range from 20% to about 80% of the base stock.

Prior Art Mold Release Agents

Mold release agents are utilized in the shaping and molding of materials. The quality and economics of finished product that results from this process are contributed to in part by the effectiveness of the material and the surface of the mold. Hence the variety of prior art of mold release agents is extensive. Many of the early release agents are based on paraffin oils, mineral oils, silicone oil, carboxylic acid derivatives, glycols. Solid based release agents include mica, graphite, talc, etc. More recently, perfluorinated silicone derivatives have been described in the art (U.S. Pat. No. 5,079,299) and glycol derivatives have been proposed as mold release agents/lubricants for rubber tires (U.S. Pat. No. 4,501,616). If some of these agents are used for high temperature applications, they will decompose and will foul the mold. Others can be used, but they are generally solids and have the standard drawbacks of poor coverage and flaking.

In all cases the prior art for lubricants and for mold release agents fail to utilize nanoscopic entities as base stocks for lubrication applications. Nor does the prior art teach the use of nanoscopic entities as additives for the improvement of the characteristics of existing lubricant properties such as operational temperature range, wear rate, oxidative stability, flammability. Furthermore the prior art fails to recognize the contribution that nanoscale compounds and materials with high thermal stabilities and spherical shapes can have on the tribological properties that are critical to control of friction, wear, and lubrication of interacting surfaces through their action as molecular ball bearings.

Polyhedral oligomeric silsesquioxane (POSS) dimers, cage molecules, polymers and resins as well as polyhedral oligomeric silicate (POS) (spherosilicate) cage molecules, polymers and resins are increasingly being utilized as building blocks for the preparation of novel catalytic materials and as performance enhancement additives for commodity and engineering polymers. Their nanometer size and unique hybrid (inorganic-organic) chemical composition are responsible for the many desirable property enhancements that have been observed upon incorporation of POSS/POS reagents into polymer systems. The thermochemical properties of POSS molecules is quite high and has been studied in detail by Mantz and coworkers. See Mantz, R. A., Jones, P. F., Chaffee, K. P., Lichtenhan, J. D., Gilman, J. W., Ismail, I. M. K., Burmeister, M. J. *Chem. Mater.,* 1996, 8, 1250–1259. Nanoscopic POSS building blocks have been used to modify the surfaces of metals to improve their corrosion resistance (Banaszak Holl, M. M., Briant, C. L. U.S. Pat. No. 5,858,544 (1999)) and to compatibilize fillers, thus demonstrating their utility for surface modification. This prior art however has failed to describe the use of POSS nano-building blocks as agents for specifically and rationally controlling the tribological properties of surfaces, lubricants and release agents. Nanoscopic POSS compounds exist as both solids and liquids which makes them suitable as both replacement lubricants, mold releases and as performance additives to existing lubricants and mold releases.

SUMMARY OF THE INVENTION

This invention teaches the use of nanoscale POSS-chemicals as lubricants, release agents, and as performance additives for lubricants and release agents for the introduction of nanoscopic tribological aids that improve the interfacial properties of material surfaces with specific enhancement of viscosity, wear resistance, friction reduction, and thermal and oxidative stability. The precisely defined nanoscopic features provided by the POSS agents further serve to compatibilize and provide multi-length scale levels of reinforcement in lubricants, release agents, paints, and coatings. POSS agents can be incorporated into lubricants and release agents using compounding, reactive processing and grafting and they can be applied to surfaces using all conventional coating techniques including slurry, coating, painting spraying, flowing and vapor deposition techniques. A wide variety of POSS formula is readily available from commercial silane feedstocks.

BRIEF DESCRIPTION OF THE DRAWINGS

FIG. 1 shows examples of common silsequioxanes, silicate, POSS nanostructures and fragments;

DEFINITION OF FORMULA REPRESENTATIONS FOR NANOSTRUCTURES

Nanoscale Chemicals are defined by the following features. They are single molecules and not compositionally fluxional assemblies of molecules. They possess polyhedral geometries with well-defined three-dimensional shapes. Clusters are good examples whereas planar hydrocarbons, dendrimers and particulates are not. They have a nanoscopic size that ranges from approximately 0.7 nm to 5.0 nm. Hence, they are larger than small molecules but smaller than macromolecules. They have systematic chemistries that enable control over stereochemistry, reactivity and their physical properties.

For the purposes of understanding this invention's nanoscale chemical compositions, the following definition for formula representations of Polyhedral Oligomeric Silsesquioxane (POSS) and Polyhedral Oligomeric Silicate (POS) nanostructures is made.

$[(RSiO_{1.5})_n(R'SiO_{1.5})_m]_{\Sigma\#}$ for heteroleptic compositions (where R≠R')

$[(RSiO_{1.5})_n(RXSiO_{1.0})_m]_{\Sigma\#}$ for functionalized heteroleptic compositions (where R groups can be equivalent or inequivalent)

$[(RSiO_{1.5})]_\infty$ for polymeric compositions $[(XSiO_{1.5})]_{\Sigma\#}$ for homoleptic silicate compositions In all of the above R=organic substituent (H, siloxy, cyclic or linear aliphatic or aromatic groups that may additionally contain reactive functionalities such as alcohols, esters, amines, ketones, olefins, ethers or halides). X includes but is not limited to OH, Cl, Br, I, alkoxide (OR), acetate (OOCR), peroxide (OOR), amine ($NR_2$) isocyanate (NCO), and R. The symbols m and n refer to the stoichiometry of the composition. The symbol Σ indicates that the composition forms a nanostructure and the symbol # refers to the number of silicon atoms contained within the nanostructure. The value for # is usually the sum of m+n. It should be noted that Σ# is not to be confused as a multiplier for determining stoichiometry, as it merely describes the overall nanostructural characteristics of the system (aka cage size).

POSS Fragments are defined as structural subcomponents that can be assembled into POSS nanostructures and are represented by formula $[(RSiO_{1.5})_n(RXSiO_{1.0})_m]$. Note the symbols Σ# are absent as these fragments are not polyhedral nanostructures.

Examples of common silsequioxane, silicate, POSS nanostructures and fragment are shown in FIG. 1.

DETAILED DESCRIPTION OF THE INVENTION

Figure 2:
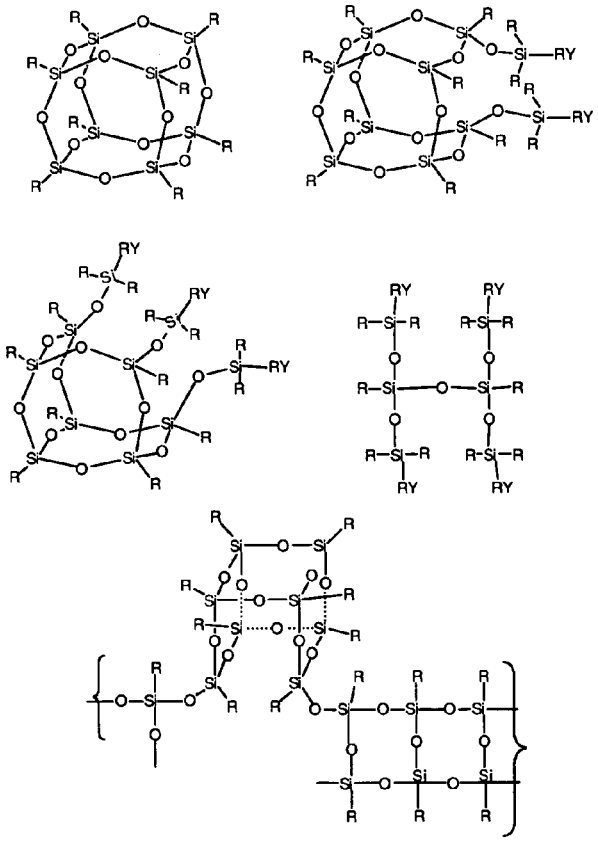
FIG. 2 shows examples of POSS/POS nanostructures, fragments, and resins for areas lubricants, releases, and additives.

Representative formulas for nanoscale POSS/POS Chemicals that are desirable for use as lubricant and mold release replacements or as performance additives to lubricants and mold release agents are shown below in FIG. 2.

Their features include a unique hybrid (organic-inorganic) composition that possesses many of the desirable physical characteristics of both ceramics (thermal and oxidative stability) and polymers (processibility and toughness). In addition they possess an inorganic skeleton, comprised of silicon-oxygen bonds, which is externally covered by compatiblizing organic groups R and reactive groups Y where R=organic substituent (H, siloxy, cyclic or linear aliphatic or aromatic groups that may additionally contain reactive functionalities such as alcohols, esters, amines, ketones, olefins, ethers or halides). Y includes but is not limited to OH, Cl, Br, I, alkoxide (OR), acetate (OOCR), peroxide (OOR), amine ($NR_2$) isocyanate (NCO), olefin, and R. This inorganic skeleton coupled with the peripheral groups combine to form chemically precise cubic like low density nanoscopic materials that exist as oils greases and solids which makes them suitable for use as lubricants, release agents or as additives to existing lubricant and release agent formulations.

Methods describing the systematic variation of cage size and distribution (U.S. patent application Ser. No. 09/631,435) (the disclosure of which is hereby incorporated by reference) along with the systematic variation of R and R-Y groups on the POSS/POS systems have been accomplished using the following methods: silation, U.S. Pat. No. 5,484,867; hydrosilation, U.S. Pat. No. 5,939,576; metathesis, U.S. Pat. No. 5,942,638, group substitution, U.S. Pat. No. 6,100,417; and through direct synthesis (U.S. Pat. No. 5,047,492 and U.S. patent application Ser. No. 10/186,318) (the disclosure of which is hereby incorporated by reference). The design and synthesis of POSS/POS compounds with cage sizes and shapes along with R and RY groups desirable for lubricants and release applications has been accomplished using the above mentioned methods.

Therefore, POSS compositions containing mixtures of R groups on each cage are prepared by known methods, such as simple mixing or by the reaction of POSS vinyls or silicon hydrides with an olefinic compound (as taught in U.S. Pat. No. 5,939,576). For example, a mixture of silsesquioxanes of the average general formula $(c\text{-}C_6H_{11}SiO_{1.5})_2(OSi(CH_3)_2(CH_2)_7CH_3)_2(OSi(CH_3)_2(CH_2)_9CH_3)_2$ can be made by the hydrosilation of $(c\text{-}C_6H_{11}SiO_{0.5})_2(OSi(CH_3)_2H)_4$ with an equal amounts of 1-octene and 1-decene. Alternatively, a similar mixture of the average general formula $(c\text{-}C_6H_{11}SiO_{0.5})_2(OSi(CH_3)_2(CH_2)_7CH_3)_2(OSi(CH_3)_2(CH_2)_9CH_3)_2$ can be made by the simple mixing of equal amounts of $(c\text{-}C_6H_{11}SiO_{0.5})_2(OSi(CH_3)_2(CH_2)_7CH_3)_4$ and $(c\text{-}C_6H_{11}SiO_{0.5})_2(OSi(CH_3)_2(CH_2)_9CH_3)_4$. Similarly POSS/POS lubricants and mold release agents can be prepared by the hydrosilation of hydride containing POS compounds with various alpha olefins. For example, a POS oil can be made by the hydrosilation of $[(HSiO_{1.5})_8]_{\Sigma 8}$, $[(HSi(CH_3)_2OSiO_{1.5})_8]_{\Sigma 8}$ and 1-octene. In addition, POSS lubricants and mold release agents can also be prepared by the cross metathesis of vinyl containing POSS compounds with various alpha olefins. For example, POSS oils can be made by the cross metathesis/hydrogenation of $[(VinylSiO_{1.5})_8]_{\Sigma 8}$ and a mixture of 1-octene and 4-methylpentene.

In prior art it is known that various mixtures of materials can serve to depress freezing points, melting points and boiling points relative to pure forms of the individual components. The same phenomena are also observed for mixtures of different POSS compositions and for mixtures of various cages sizes. For example the melting point of pure $[(VinylSiO_{1.5})_8]_{\Sigma 8}$ is known to be over 350° C. while the melting point for a 2% $[(VinylSiO_{1.5})_8]_{\Sigma 8}$, 16% $[(VinylSiO_{1.5})_{10}]_{\Sigma 10}$, 82% $[(VinylSiO_{1.5})_{12}]_{\Sigma 12}$ mixture is 152° C. Various stabilizers such as organophosphate esters, aromatic amine compounds, antioxidants, etc. can also be added to POSS/POS systems to both depress melting and freezing points as well as to improve property performance.

TABLE 1

Functionalities for use on POSS/POS lubricants, and releases agents.

| R | R-Y |
|---|---|
| Hydride | Mercapto |
| Aliphatics and Aromatics | Aliphatic and Aromatic Amines, Imides |
| Aliphatic and Aromatic Halides | Aliphatic and Aromatic Halides |
| Aliphatic and Aromatic Amines, Imides, Ammoniums | Aliphatic and Aromatic Esters, and Ethers |
| Olefin, Vinyl, and Strained Olefins | Aliphatic and Aromatic Alcohols |
| Aliphatic and Aromatic Esters | Aliphatic and Aromatic Phosphines and Phosphates |
| Aliphatic and Aromatic Alcohols | Aliphatic and Aromatic Salts |
| Aliphatic and Aromatic Salts | |

Figure 3:
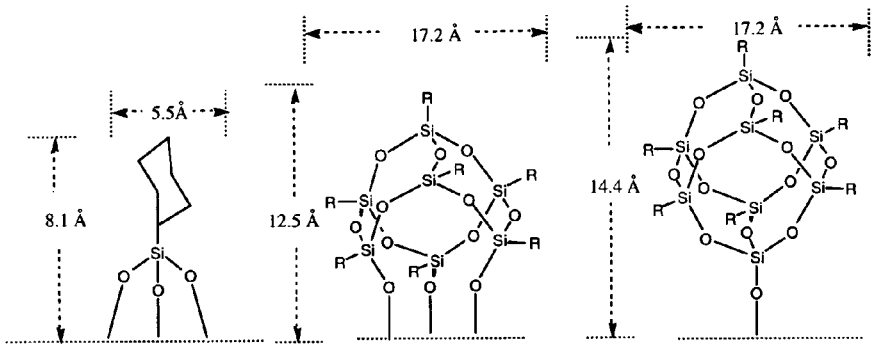
FIG. 3 shows physical size relationship of a traditional silane applied to a surface as a monoscale and of nanoscale coupling agents applied as monolayers.

An additional advantageous feature provided by nanoscale materials, like POSS, is that a single molecule is capable of providing five times the surface area coverage relative to that provided by comparable silane coupling agents applied in the hypothetical monolayer fashion. The dimensions utilized for the example in FIG. 3 are taken from single crystal X-ray data published by Feher et al for systems where R=cyclohexyl.

Surface modifications using POSS-mercapto systems have been shown to be advantageous in both aiding the dispersibility of fillers and in improving their interfacial compatibility. (Schmid, G., Pugin, R., Malm, J-O., Bovin, J-O., *Eur. J. Inorg. Chem.* 1998, 813–817). When applied to surfaces nanoscale chemicals provide the advantage of multi-length scale reinforcement at nanometer dimensions (nm=$10^{-9}$ meters).

Nanoscale Chemicals for Lubricants and Release Agents

The improvement of tribological properties through use of POS/POSS compositions and Molecular Silicas™ is demonstrated through the following examples.

Prior art has not been able to adequately control tribological properties at a molecular level due to the absence of appropriately sized and structurally rigid building blocks which possess both controlled diameters, distributions and with tailorable chemical functionality. Furthermore the mismatch of chemical potential (solubility, miscibility) between hydrocarbon and inorganic, or metallic surfaces has resulted in a high level of heterogeneity in compounded polymers.

Figure 4:
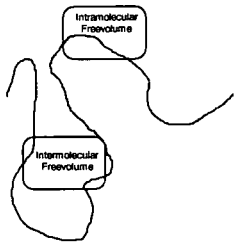
FIG. 4 illustrates inter and intramolecular free volume for a lubricant.

The keys that enable nanoscale chemicals to function as molecular level lubricants and additives are (1) their unique spherical topology and nanoscopic size which ranges from 0.7 nm to 3.0 nm and enables them to function as molecular ball bearings and (2) their ability to be compatibilized and overcome repulsive forces that induce incompatibility and expulsion from dissimilar material surfaces and conventional lubricants and mold releases. It has long been known that in the solid-state all polymers, and lubricious materials possess considerable amounts of internal and external free volume (FIG. 4). (G. R. Mitchell in "Order in the Amorphous State of Polymers," S. E. Keinath, R. L. Miller, J. K. Rieke Eds., Plenum, N.Y., pp 8 (1985)).

The amount of free volume present is highly dependent upon the composition, morphology, and the thermodynamic and kinetic factors associated with its nonequilibrium and equilibrium properties. The free volume also has a tremendous impact on its physical properties, since it is within this volume that the properties such as thermal conductivity, diffusion and lubrication are controlled.

The size of POSS is roughly equivalent to that of most chain dimensions, thus at a molecular level POSS can effectively alloy the free volume of existing lubricant formulations (see Table 2).

TABLE 2

Relative sizes of POSS, polymer dimensions, and fillers.

| Particle Type | Particle Diameter |
|---|---|
| Amorphous Polymer Segments | 0.5–5 nm |
| Octacyclohexyl POSS | 1.5 nm |
| Random Polymer Coils | 5–10 nm |
| Colloidal Silica | 9–80 nm |

Figure 5:
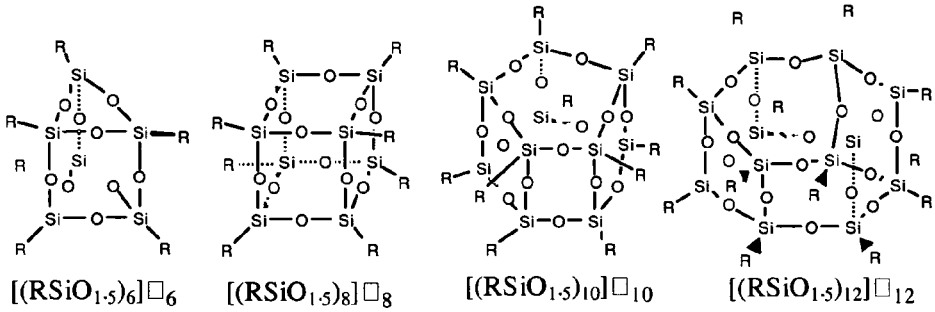
FIG. 5 shows examples of monodisperse Molecular Silicas.

POSS's ability to occupy specific sites within the amorphous and crystalline region of materials enables them to alter the free volume contained within the material. The availability of a wide range of sizes of POSS nanostructures (cages) further augments this capability (FIG. 5).

Furthermore, because POSS nanoscale chemicals possess spherical shapes, like molecular spheres, and because they dissolve and melt, they are also effective at reducing the viscosity in polymeric and similar systems. Viscosity reduction is desirable in order to maintain the processability of lubricants at low temperatures.

Figure 6:
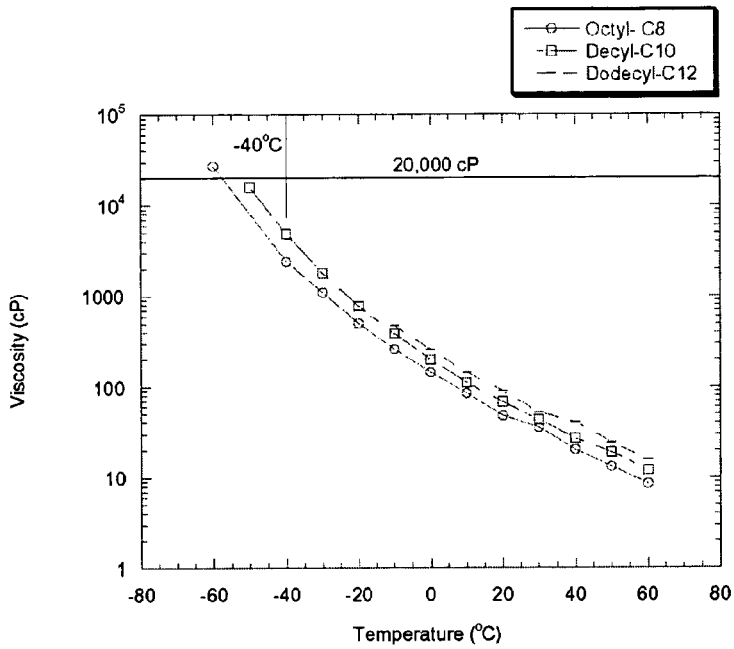
FIGS. 6, 7, and 8 show viscosity behavior for POSS-based lubricants.
Figure 7:
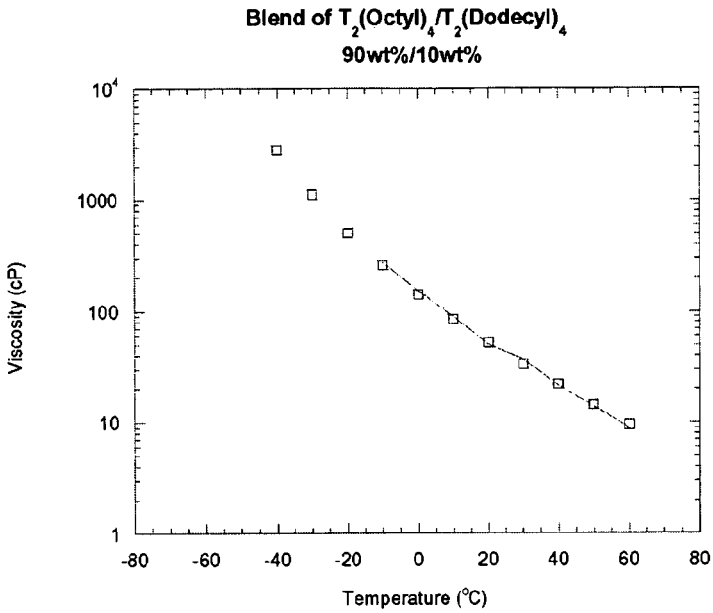
Figure 8:
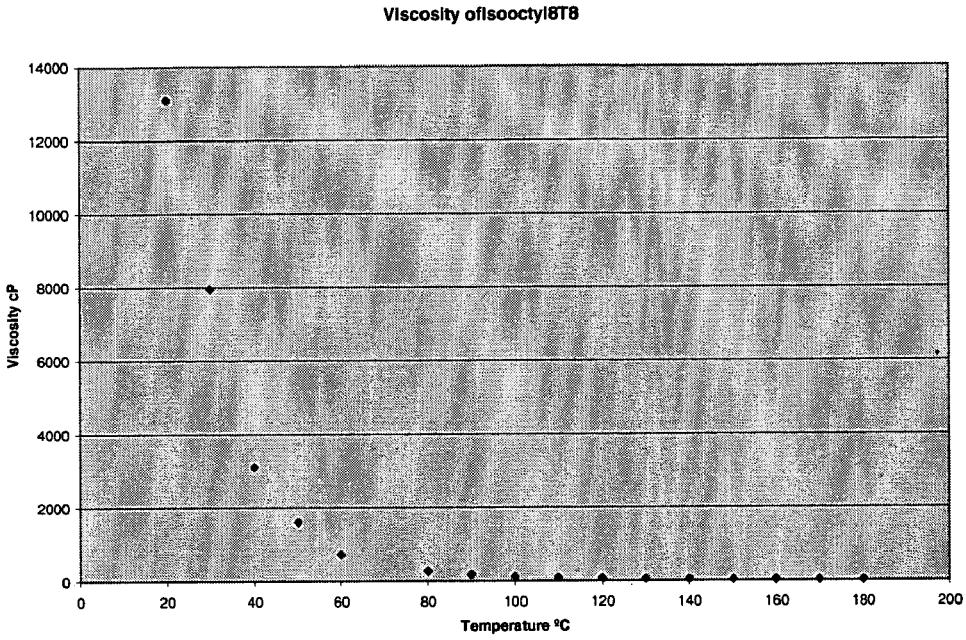

The viscosity of POSS-based lubricants and lubricant blends over a wide range of temperatures has been shown to follow Newtonian behavior and hence behaves similarly to that of other lubricants (Table 3 and FIGS. 6–8). The fluids exhibit low temperature pourability and lower viscosity at elevated temperatures.

TABLE 3

Tabulated temperature and viscosity data for two POSS fluids.

| Composition | Melt (° C.) | Viscosity cP (° C.) | Viscosity cP (° C.) | Viscosity cP (° C.) |
|---|---|---|---|---|
| $[(n\text{-octylSiO}_{1.5})_{4.5}(4\text{-methylpentylSiO}_{1.5})_{3.5}]_{\Sigma 8}$ | −10 | 1650 (0) | 11 (110) | 1 (210) |
| $[(\text{isooctylSiO}_{1.5})]_{\Sigma 10}$ | −30 | 13100 (20) | 79 (110) | 13.8 (180) |
| $[(c\text{-hexylSiO}_{0.5})_2(n\text{-octyl}(CH_3)_2SiO_{1.0})_4]$ | <−60 | 28,000 (−60) | 2600 (−40) | NA |

The thermal behavior for a number of POSS-based lubricants is shown below in Table 4.

TABLE 4

Thermal characteristics for selected POSS-type lubricants relative to standard.

| Composition | Melting Point ° C. | Iso-thermal Stability Temp ° C. | Time to 10 wt % mass loss-min | Mass loss @ 9 hr-% |
|---|---|---|---|---|
| *Base Lubricant MIL-L-7808 | N/A | 219 | 30 | 90 |
| $[(n\text{-octylSiO}_{1.5})_8]_{\Sigma 8}$ | 50 | 218 | 60 | 27 |
| $[(i\text{-octylSiO}_{1.5})_8]_{\Sigma 10}$ | −30 | 200 | 500 | 11 |
| **$[(i\text{-octylSiO}_{1.5})_8]_{\Sigma 10}$ | −30 | 200 | N/A | 2 |
| **$[(i\text{-octylSiO}_{1.5})_8]_{\Sigma 10}$ | −30 | 225 | N/A | 9 |
| $[(n\text{-octylSiO}_{1.5})_7(\text{ethylSiO}_{1.5})_1]_{\Sigma 8}$ | 45 | 216 | 225 | 11 |
| $[(n\text{-octylSiO}_{1.5})_{4.5}(4\text{-methylpentylSiO}_{1.5})_{3.5}]_{\Sigma 8}$ | −10 | 215 | 391 | 12 |
| $[(c\text{-hexylSiO}_{0.5})_2(n\text{-octyl}(CH_3)_2SiO_{1.0})_4]$ | <−40 | 219 | Evap. | 100 |
| **$[(c\text{-hexylSiO}_{0.5})_2(n\text{-decyl}(CH_3)_2SiO_{1.0})_4]$ | <−40 | 200 | N/A | 3 (@2hr) |

*MIL-L-7808 polyester based lubricant.
**sample contained 5% Irganox 1076 as an antioxidant.

The incorporation of POSS/POS into lubricants and releases can be accomplished through conventional blending and mixing techniques including both high and low shear mixing, milling, solvent and supercritical fluid assisted blending.

The degree of enhancement of physical properties is dependant upon the loading level of the POSS/POS component incorporated, the size of the silicon-oxygen cage, the size of the nanostructure (R-group effects), the of incorporation, and the interfacial compatibility between the lubricant—the nanostructure—and the surfaces.

POSS/POS can be used both as a stand alone lubricant/release or as an additive to existing lubricant/release formulations. POSS incorporation as an additive into existing lubricants has been shown to effect significant improvements in reducing the wear of metal components with little effect on viscosity. (Table 5) In addition to reducing wear, such lubricant formulations also typically show increased operational temperatures ranging from 1° F. to 100° F.

TABLE 5

Wear testing for selected POSS-type lubricants relative to standard.

| | Coefficient of Friction | Wear Length (mm) | Wear Improvement (%) |
|---|---|---|---|
| MIL-L-7808 | 0.100 | 0.868 | baseline |
| L-7808 + 5 wt % $[(n\text{-octylSiO}_{1.5})_7(\text{ethylSiO}_{1.5})_1]_{\Sigma 8}$ | 0.138 | 0.701 | 19 |
| L-7808 + 5 wt % $[(n\text{-octylSiO}_{1.5})_8]_{\Sigma 8}$ | 0.118 | 0.645 | 25 |
| L-7808 + 5 wt % $[(c\text{-hexylSiO}_{0.5})_2(n\text{-octyl}(CH_3)_2SiO_{1.0})_4]$ | 0.109 | 0.581 | 33 |

Testing was conducted three ball-on-disc apparatus at 75° C., for 3 hours, at 246 rpm under a 20 kg load.

EXAMPLES

Alloying Lubricants with POSS Molecular Silicas™. Prior to mixing all Molecular Silicas™ and polymers should be predried at 60° C. to 100° C. under vacuum for three hours or via a similarly effective procedure to ensure removal of traces of water or other volatiles. POSS Molecular Silicas™ are introduced using a weight loss feeder at the desired wt % into the mixing vessel of a shear mixer containing the desired lubricant (or release) formulation components. The mixing residence time can be varied from 1 min to 60 min prior use of the formulation. If desired the lubricant formulation can be filtered to ensure removal of any heterogeneous components and grade qualification.

Solvent Assisted Application Method for Formulation. POSS/POS additives along with the desired lubricant formulation are added to a vessel and dissolved in a sufficient amount of an organic solvent (e.g. hexane, toluene, dichlormethane etc.) to effect the formation of one homogeneous phase. The mixture is then stirred at room temperature for 30 minutes and the volatile solvent is then removed and recovered under vacuum or using a similar type of process including distillation. Note that supercritical fluids such as $CO_2$ can also be utilized as a replacement for the flammable hydrocarbon solvents. The resulting lubricant/release formulation may then be either used directly.

Although the present invention has been described above, it will be appreciated that certain alterations or modifications thereon will be apparent to those skilled in the art. It is therefore that the appended claims be interpreted as covering all such alterations and modifications that fall within the true spirit and scope of the invention.

What is claimed is:

1. A method for lubrication of a substrate comprising contacting the substrate with a lubricating composition, said lubricating composition including a lubricant and an additive selected from the group consisting of polyhedral oligomeric silsesquioxane nanostructures and polyhedral oligomeric silicate nanostructures.

2. The method of claim 1, wherein the nanostructures have a particle diameter between 0.7 nm and 3.0 nm.

3. The method of claim 1, wherein the lubricant and the additive are non-reactively blended.

4. The method of claim 1, wherein the additive is sized to occupy specific sites within the lubricant, altering the free volume contained within the lubricating composition.

5. The method of claim 2, wherein the additive is sized to occupy specific sites within the lubricant, altering the free volume contained within the lubricating composition.

6. The method of claim 1, wherein the lubricant and the additive are reactively blended.

* * * * *